United States Patent [19]

Bick

[11] 4,325,307

[45] Apr. 20, 1982

[54] BUFFER STOP

[75] Inventor: David E. Bick, Newent, England

[73] Assignee: Dowty Hydraulic Units Limited, Cheltenham, England

[21] Appl. No.: 146,892

[22] Filed: May 5, 1980

[30] Foreign Application Priority Data

May 25, 1979 [GB] United Kingdom ..... 18254/79

[51] Int. Cl.[3] ..... B61K 7/18

[52] U.S. Cl. ..... 104/256

[58] Field of Search ..... 104/254–256

[56] References Cited

U.S. PATENT DOCUMENTS

| | | | |
|---|---|---|---|
| 1,349,387 | 8/1920 | Simpson | 104/256 |
| 3,828,688 | 8/1974 | Bradbury | 104/256 |

FOREIGN PATENT DOCUMENTS

| | | | |
|---|---|---|---|
| 859757 | 1/1961 | United Kingdom | 104/256 |
| 1123981 | 8/1968 | United Kingdom | 104/256 |
| 1156661 | 2/1969 | United Kingdom | 104/256 |

*Primary Examiner*—Richard A. Bertsch

*Attorney, Agent, or Firm*—Ladas & Parry

[57] ABSTRACT

A buffer stop comprising an arm capable of being pivotally-mounted at or near one end portion on or adjacent a railway track, and a piston-and-cylinder device. One end portion of the piston-and-cylinder device is pivotally-connectible at or near the other end portion of the arm. The other end portion of the device is capable of being pivotally-mounted on or adjacent the railway track at a distance away from the one end portion of the arm.

11 Claims, 4 Drawing Figures

BUFFER STOP

Figure 1:
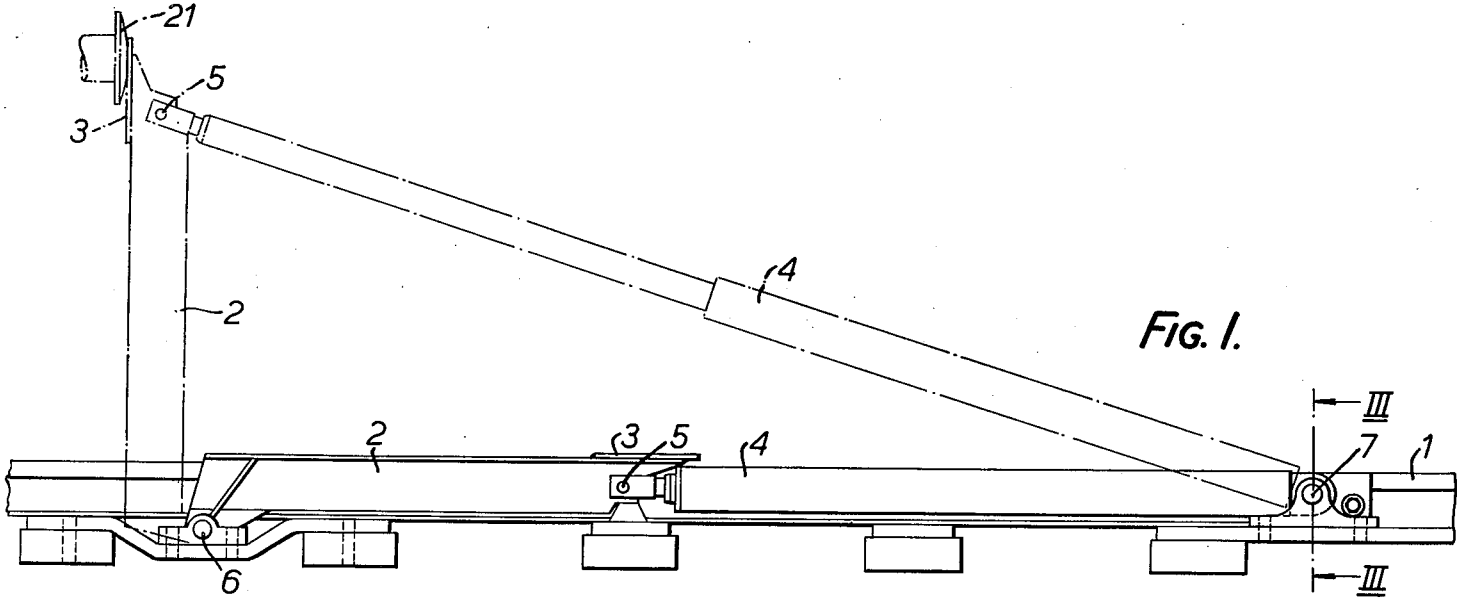

This invention relates to a buffer stop suitable for use with railway rolling stock.

According to the invention a buffer stop comprises an arm capable of being pivotally-mounted at or near one end portion on or adjacent a railway track, and a piston-and-cylinder device, one end portion of which is pivotally-connectible at or near the other end portion of the arm and the other end portion of which is capable of being pivotally-mounted on or adjacent the railway track at a distance away from said one end portion of the arm.

When mounted on or adjacent a railway track the arm will normally be in an upright or nearly-upright position when it is required to stop a railway wagon or to hold it on a gradient. The arm will be urged towards its normally-upright or nearly-upright position by applying fluid under pressure to the piston-and-cylinder device so as to extend, or alternatively to contract, the device.

At its then uppermost end portion, the arm will carry a suitable means, for example, a head, which can be engaged by a buffer of a railway wagon rolling along the railway track.

Thus, it can bring a slow-moving wagon to a stop, the piston-and-cylinder device then acting as an energy-absorbing device.

If, for some reason, the buffer stop when mounted on or adjacent a railway track is not required to bring a moving wagon to a stop, or has to be removed in order to allow further movement along the track of a wagon which has been brought to a stop, the piston-and-cylinder device can be shortened, or alternatively lengthened, by the suitable application of fluid under pressure thereto, thereby retracting the arm about its pivotal mounting so that, eventually, both the arm and the device lie substantially alongside a rail of the track in positions which will not interfere with the movement of a wagon along the track.

The buffer stop can be used to arrest a wagon, to which can then be connected a rake of wagons. When the rake of wagons has been made up, the brakes of one or more of the wagons can be applied and the arm then retracted to its inoperative position. The arm during such retraction will, of course, move away from the first wagon of the rake. A railway locomotive can then be brought up to the rake of wagons and be connected to the first wagon of the rake. The wagon brakes can then be disengaged and the locomotive, travelling in the direction in which the wagons of the rake were moving before being stopped by the arm, can propel the rake of wagons along the track.

The arm and the piston-and-cylinder device are preferably pivotally-mounted on the railway track (that is, either on the rails or on the sleepers, or both) so that the forces applied to the arm will be transferred to the track. Further, the arm and the piston-and-cylinder device are preferably pivotally-mounted outside the track rather than between the rails of the track.

Conveniently, one buffer stop can be mounted on the outer side of one rail of a railway track and another buffer stop can be mounted on the outer side of the other rail of the track. Thus they can be simultaneously engaged by the two buffers, or by a single buffer bar, of a railway wagon. Alternatively, one buffer stop can be mounted between the two rails of a railway track, if railway wagons which are incident against the buffer stop have a centrally-disposed buffer.

Suitable stop means, either mechanical or fluid, can be associated with the buffer stop so that, if there is a loss of fluid pressure in the piston-and-cylinder device, it can come into operation, say, after a certain degree of travel of the arm has taken place when impacted by a wagon.

A wagon incident against the buffer stop can have its speed of approach towards the buffer stop adjusted by track-mounted wagon-speed-controlling devices so that its energy is reduced to an amount which is capable of being absorbed by the piston-and-cylinder device.

Figure 2:
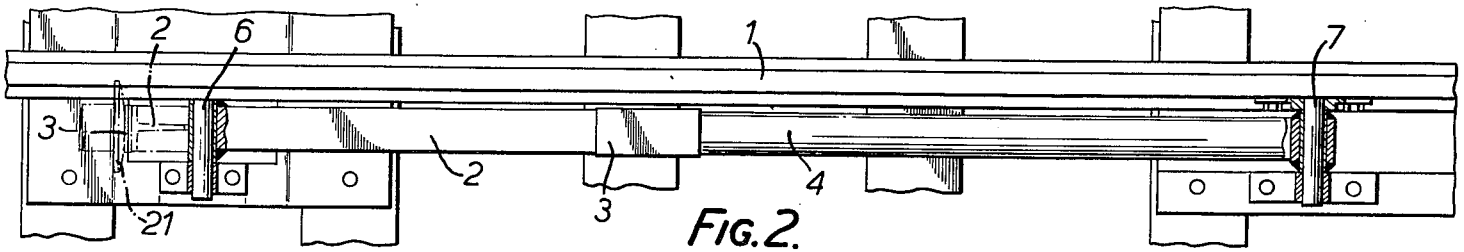
Figure 3:
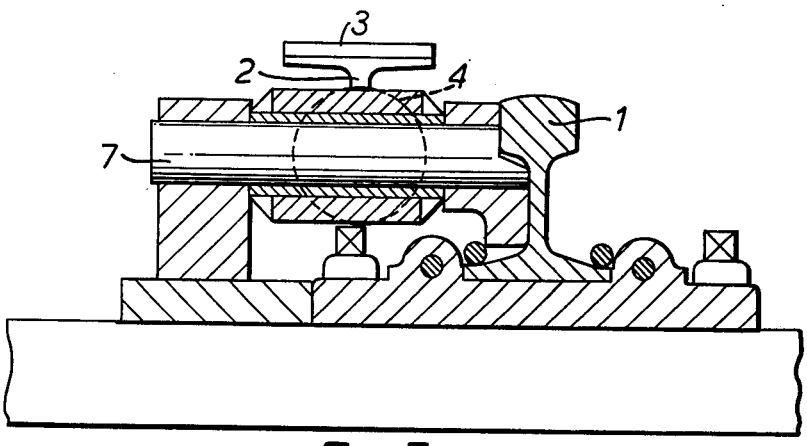
Figure 4:
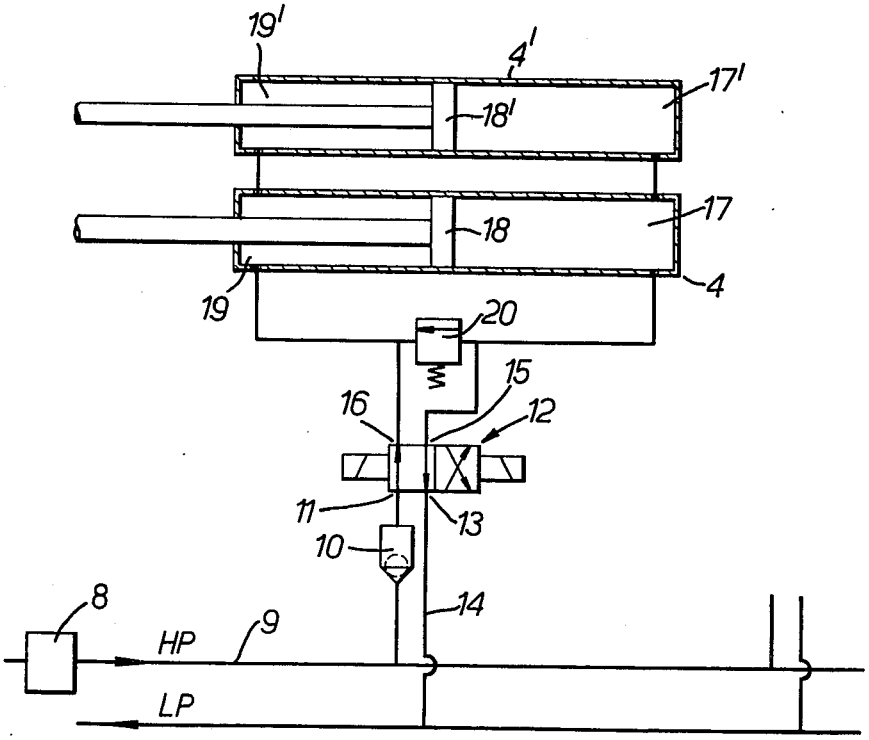

One way of carrying out the invention is described in detail below with reference to drawings which illustrate only one specific embodiment, in which:

FIG. 1 is a side elevation of a buffer stop shown in its retracted condition in full lines and in its extended condition in broken lines, FIG. 2 is a plan view of the buffer stop shown in FIG. 1, FIG. 3 is a cross-section taken along the line III—III on FIG. 1, and, FIG. 4 is a diagrammatic representation of an hydraulic circuit associated with the buffer stop of FIGS. 1 to 3.

The figures show a buffer stop associated with one side 1 of a railway track. The buffer stop includes an arm 2, a head 3 on the arm for impact by the buffer of a railway wagon, and a piston-and-cylinder device 4. The arm 2 and the device 4 are pivotally connected at 5, the arm 2 is pivotally-mounted on the track at 6, and the device 4 is pivotally-mounted on the track at 7.

In the condition shown in broken lines in FIG. 1 the buffer stop is in its "wagon-arresting position", and in the retracted condition, shown in full lines in FIG. 1, the pivotal connection 5 of the arm 2 to the device 4 is above the line joining the centres of the pivotal mountings 6 and 7.

The hydraulic circuit shown in FIG. 4 includes a pump 8, capable of off-loading, which is connected by way of a high pressure line 9 and a non-return valve 10 to an inlet port 11 of a solenoid-operated control valve 12 which has an outlet port 13 connected to low pressure by a line 14. The control valve 12 has two control ports 15 and 16. The control port 15 is connected to the chamber 17 on one side of the piston 18 of the piston-and-cylinder device 4 forming part of the buffer stop shown in FIGS. 1 to 3. The control port 16 is connected to the chamber 19 on the other side of the piston 18.

In one of the two operative positions of the valve 12, liquid under pressure will flow from the pump 8 to the chamber 17 to extend the device 4 and thus the buffer stop, and in the other of the two operative positions of the valve, liquid under pressure will flow from the pump to the chamber 19 to contract the device 4 and thus retract the buffer stop. Hence, in this mode of operation the device acts as an extendible and contractible fluid-pressure-operable device. The chamber 17 is connected to the chamber 19 by way of relief valve 20, which in practice is provided in the piston 18, so that if a force in excess of that at which the relief valve opens is applied to the arm 2 when in its upright or nearly-upright position, flow of liquid from the chamber 17 to the chamber 19 can take place, in this mode of operation the device 4 then acting as an energy-absorbing device.

As shown in FIG. 4, the single control valve 12 controls the supply of liquid to, and exhaust from, not only the device 4 forming part of the buffer stop shown in FIGS. 1 to 3 which is mounted on the outer side of one rail of the track, but also controls the supply of liquid to, and exhaust from, the parallel piston-and-cylinder device 4' of a buffer stop (not shown) mounted on the outer side of the other rail of the track. For this purpose the chambers 17' and 19' on either side of the piston 18' of the device 4' are suitably respectively connected to the chambers 17 and 19 of the device 4. In operation, the two buffer stops, when in their extended condition, are simultaneously engageable by respective buffers, as at 21, of a railway wagon.

In practice only one relief valve 20, which in effect is common to the piston-and-cylinder devices of both buffer stops, needs to be used.

In alternative embodiments of the invention more than two such buffer stops can be provided and the piston-and-cylinder devices thereof be connectible with a pump common to them all.

Although in the embodiment above-described with reference to the drawings the piston-and-cylinder device of the or each buffer stop is disposed on that side of the respective arm remote from an approaching wagon, in alternative embodiments each piston-and-cylinder device is instead disposed on the same side of the buffer stop as an approaching wagon. In this case instead of the piston-and-cylinder device being contractable for buffer retraction, it is extendible for buffer retraction.

Wagon-speed-controlling devices can be mounted at desired intervals along the railway track for such engagement by the wheels of a wagon as will afford adjustment in the speed of approach of the wagon towards the buffer stop or stops so that the energy of the wagon can be reduced to an amount which is capable of being absorbed by the piston-and-cylinder device of the or each buffer stop.

I claim:

1. A buffer stop comprising an arm, capable of being pivotally-mounted at one end portion in the region of a railway track, and a piston-and-cylinder device adapted to act in one mode of operation as an energy-absorbing device and in another mode of operation as an extendible and contractible fluid-pressure-operable device, one end portion of said device being pivotally-connectible to the other end portion of the arm and the other end portion of said piston and-cylinder device being adapted for direct pivotal connection to structure fast with respect to the railway track at a distance away from said one end portion of the arm.

2. A buffer stop as claimed in claim 1, wherein said arm is urged towards its substantially upright position by applying fluid under pressure to said piston-and-cylinder device so as to extend, or alternatively to contract, said device.

3. A buffer stop as claimed in claim 2, wherein upon shortening, or alternatively lengthening, said piston-and-cylinder device by the suitable application of fluid under pressure thereto, said arm is retracted about its pivotal mounting so that, eventually, both said arm and said piston-and-cylinder device lie substantially alongside a rail of said track in positions which do not interfere with the movement of a wagon along the track.

4. A buffer stop as claimed in claim 1, wherein said arm and said piston-and-cylinder device are pivotally-mounted outside of said track.

5. A railway track wherein two of said buffer stops as claimed in claim 1 are provided, one mounted on the outer side of one rail of the track, and the other mounted on the outer side of the other rail of the track, the two buffer stops when in their extended condition being simultaneously engageable by buffer bar means of a railway wagon.

6. A railway track wherein a buffer stop as claimed in claim 1 is mounted between the two rails of said track for engagement by that type of railway wagon having a centrally-disposed buffer.

7. A railway track wherein a buffer stop as claimed in claim 1 is provided in association with track-mounted wagon-speed-controlling devices for adjusting the speed of approach of a wagon towards said buffer stop so that the energy of the wagon is reduced to an amount which is capable of being absorbed by said piston-and-cylinder device.

8. A buffer stop as claimed in claim 1, wherein said arm is capable of being pivotally-mounted at said one end portion on said railway track.

9. A buffer stop as claimed in claim 1, wherein said arm is capable of being pivotally-mounted at said one end portion adjacent said railway track.

10. A buffer stop as claimed in claim 1, wherein, for preventing movement of a railway wagon, said arm is normally disposed in a substantially-upright position.

11. A buffer stop as claimed in claim 10, wherein said arm carries a head which can be engaged by a buffer of a railway wagon rolling along the railway track.

* * * * *